United States Patent [19]

Runkel et al.

[11] Patent Number: 4,641,504

[45] Date of Patent: Feb. 10, 1987

[54] YARN HEATING CHAMBER

[75] Inventors: Walter Runkel; Erich Lenk; Karl Bauer, all of Remscheid, Fed. Rep. of Germany

[73] Assignee: Barmag Barmer Maschinenfabrik AG, Remscheid, Fed. Rep. of Germany

[21] Appl. No.: 743,436

[22] Filed: Jun. 11, 1985

[30] Foreign Application Priority Data

Jun. 12, 1984 [DE] Fed. Rep. of Germany ..... 3422031

[51] Int. Cl.[4] ..... D06B 3/04

[52] U.S. Cl. ..... 68/5 E; 68/6; 432/59; 34/160

[58] Field of Search ..... 68/5 C, 5 D, 5 E, 6; 432/8, 59; 34/160; 134/9, 15, 64 R, 64 P, 122 R, 122 P, 199

[56] References Cited

U.S. PATENT DOCUMENTS 3,015,872 1/1962 Jones ..... 432/59

3,533,146 10/1970 Raschle et al. ..... 432/59

3,559,255 2/1971 Cockroft ..... 432/59

4,255,134 3/1981 Schippers et al. ..... 432/59

*Primary Examiner*—Harvey C. Hornsby

*Assistant Examiner*—Frankie L. Stinson

*Attorney, Agent, or Firm*—Bell, Seltzer, Park & Gibson

[57] ABSTRACT

A yarn heating chamber is disclosed which comprises a rigid outer housing of U-shaped cross section and including transversely spaced apart side walls, and three plates mounted between the two side walls. A contact pressure gap is formed between the side walls and the adjacent surfaces of the two outer plates, and the central plate includes a yarn receiving groove on each of its outer surfaces. The central plate is laterally movable to a threading position wherein the grooves are exposed, and heating duct means is provided for introducing a hot pressurized vapor into the contact pressure gaps, to bias the two outer plates inwardly toward each other and thereby resiliently engage the central plate therebetween. The pressurized vapor is also conducted to each of the yarn receiving grooves.

13 Claims, 4 Drawing Figures

YARN HEATING CHAMBER

The present invention relates to a heating chamber for thermally processing an advancing yarn and which is suitable for treating a yarn with a pressurized and hot vapor, preferably with saturated water vapor or steam. Yarn heating chambers of this general type are disclosed in the copending and commonly owned U.S. applications Ser. Nos. 563,299; 563,300; and 563,301 and now, respectively, U.S. Pat. Nos. 4,529,378; 4,565,524; and 4,560,347.

When heating up to more than 100° C., it is advantageous to treat a traveling yarn, in particular, a multifilament synthetic yarn, with a saturated water vapor rather than a highly superheated water vapor or hot air, since the saturated water vapor has a large, latent heat content (heat of evaporation), and the yarn may be highly heated at high yarn speeds and short dwell times because of the very high heat transfer coefficients at condensation, in contrast to the convection, radiation or direct heat conduction. The treatment with saturated vapor also effects a uniform temperature distribution and a good temperature stability over the entire length of the treatment zone. Further, a treatment zone may be optionally arranged as several successive treatments chambers, since the required uniformity and consistency of the treatment temperature for several chambers can be insured by adjusting and equalizing the pressure between the treatment chambers. When correspondingly designing the yarn inlet and yarn outlet, the losses at the entry and exit ends may be kept low and lower than in comparative air heating chambers. At the outlet, the yarn is cooled by the evaporation of the previously condensed water, and if necessary, the yarn can be moistened in the area of the yarn outlet.

For the above reasons, the saturated vapor treatment chamber of the present invention is particularly suitable for such yarn treatments in which a large amount of heat must be transferred to the yarn in a relatively short dwell time and then subsequently immediately removed, such as is the case for example with synthetic fibers which are handled in spinning, spin-drawing, spintexturing, or spin-draw-texturing processes and in drawtexturing, draw-twisting, draw-winding, and other draw processes.

One problem associated with present yarn heating chambers of the described type is the fact that the heating vapor, being under an elevated pressure, escapes through the yarn inlet and the yarn outlet in such large quantities that the operation of the chamber is rendered uneconomical. To alleviate this problem, labyrinth seals and gap seals positioned at the yarn inlet and the yarn outlet are known. Labyrinth seals typically consist of a stack of discs having shutter-like openings, and which form, upon relative movement of the plates, either a wide opening in the threading position, or a labyrinth opening in the operating position. Such labyrinth seals are suitable for the threading operation, but they are basically unsuitable in operation, since the necessity of an unhindered yarn travel cannot be achieved by reason of the winding or intricate outlet path which is necessary to avoid losses of the heating vapor. Gap seals are effective in that a long gap length provides a sufficient reduction of vapor loss. However, as the gap length increases and narrows, the threading operation becomes more difficult, particularly in the case of a pneumatic threading of the yarn.

It is accordingly an object of the present invention to provide a yarn heating chamber which avoids the above mentioned disadvantages of known chambers, and which provides an effective and uniform heating of the components which enclose the advancing yarn, and which does not require close manufacturing tolerances.

These and other objects and advantages of the invention are achieved in the embodiment illustrated herein by the provision of a heating chamber which comprises a housing having a pair of transversely spaced apart and parallel side walls which extend in the longitudinal direction, and with each of the side walls defining generally parallel, inwardly facing side wall surfaces. A pair of longitudinally extending outer plates is disposed between the side walls of the housing, with each of the outer plates having an outer surface opposing the inwardly facing surface of the adjacent side wall. Also, each of the outer plates includes an opposite inner surface.

A longitudinally extending central plate is disposed between the outer plates and includes opposite outer surfaces opposing respective ones of the inner surfaces of the two outer plates. Also, each of the opposite outer surfaces of the central plate includes a discontinuity, such as a groove, extending along the longitudinal length thereof, and the central plate is laterally movable with respect to the two outer plates for movement between an operative position wherein the opposing surfaces of the plates overlie each other and the grooves defines a relatively narrow yarn passage on each side of the central plate, and a threading position wherein the grooves are separated from the opposing inner surfaces of the two outer plates to facilitate threading of yarns into the grooves.

As further aspects of the present invention, heating duct means are provided for introducing a hot pressurized vapor into the yarn passages when the plates are in the operative position, and means are provided for biasing the two outer plates toward each other so as to resiliently engage the central plate therebetween when it is in the operative position. Also, each of the inwardly facing side wall surfaces and the opposing outer surface of the adjacent outer plate define a contact pressure gap therebetween, and the biasing means preferably comprises a portion of the heating duct means which communicates with each of the gaps for conducting a portion of the hot pressurized vapor thereinto.

A pair of laterally spaced apart sealing strips are mounted between each of the inwardly facing side wall surfaces and the opposing outer surface of the adjacent outer plate, with such sealing strips extending along substantially the entire longitudinal length of the plates. These sealing strips bridge the associated contact pressure gap, and define the lateral boundaries thereof. Preferably, there are no sealing members between the central plate and the two outer plates, and thus the central plate effectively "floats" in the very rigid housing, since the two outer plates are supported by a hot vapor cushion formed in the contact pressure gaps. Since the contact pressure gaps are defined by sealing strips which have a certain elasticity, a certain tolerance between the plates and the housing is permitted, without running the risk that the opposing surfaces between which the yarns are advanced may slightly separate and form cracks into which the yarn may move and become pinched.

The yarn passage formed between the opposing surfaces of the central and outer plates in the operating position typically measures at the yarn inlet and/or yarn outlet about 0.2 to 0.5 mm in width, and so that the advancing yarn may move without hinderance, and while the loss of the heating vapor is low. The passage width may vary over its length, particularly in the area of the yarn outlet. Also, pressure relief chambers or vacuum chambers may be connected to the passage, so as to obtain a controlled pressure relief gradient along the yarn path. When dimensioning the passage width, the diameter and number of yarns to be guided in the passage are considered.

In the threading position, the yarn passage on each side of the central plate is opened, so that a threading slot is formed, and a traveling yarn may be inserted laterally into the passage. In the central area of the yarn passage, the width may be increased, which is useful in enabling a certain ballooning of the yarn, and to avoid or reduce frictional contact between the yarn and wall of the passage. The opposing surfaces of the plates may be plane or slightly curved in the longitudinal or traveling direction of the yarn and/or they may be curved transversely to the direction of the advancing yarn. Also, the surfaces need not necessarily be in one plane, and they may be disposed in two planes which intersect in the area of the surface discontinuity.

It is possible to align several of the yarn heating chambers parallel to each other, and to interconnect them by a single supply line for the heating vapor, particularly saturated water vapor. Throttling losses between the yarn ducts are thereby largely avoided, and a good stability of the resulting yarn temperatures is insured from one yarn path to another.

Where the width of the yarn passage measures about 0.2 to 0.5 mm, and a length of about 60 mm, a 167 dtex yarn may be treated with a saturated water vapor having a temperature of 220° C. and a pressure of about 24 bar, without damaging wall friction. In the operation of prior known heating chambers which utilize saturated water vapor, it has been found that stable operation is not always possible. In particular, temperature fluctuations may occur which results in a nonuniform heating of the traveling yarn. These temperature fluctuations may be, under certain circumstances, accompanied by explosion-like discharges of saturated vapor, which disturbs the yarn path.

The present invention makes it possible to avoid this difficulty of instability, for a wide range of operating conditions. This advantage is made possible by applying adequate biasing pressure forces between the opposing surfaces of the three plates, so as to avoid unacceptable losses of the saturated vapor or an unacceptable drop of the pressure of the vapor.

A further advantage of the present invention resides in the fact that a contact pressure gap is formed between each of the side walls of the housing and the two outer plates, with these gaps being supplied with the hot pressurized vapor. This provides not only the necessary contact pressure, but it also results in a uniform heating of the two outer plates. In this regard, it has been found that due to its narrow width, each yarn passage has such a small surface that the amount of heat necessary to heat the heating chamber and to equalize the heat losses cannot be transferred to the yarn via the surfaces of the passages. However, the provision of an additional surface on each of the outer surfaces of the two outer plates, which is heated with the same vapor and receives the same pressure, not only serves to equalize the heat losses but also renders the temperature uniform over the cross section of the heating chamber.

The above feature of the present invention is particularly advantageous with the present invention, and wherein the heating chamber comprises a rigid outer housing of U-shaped cross section, and with the three plates being aligned in overlying relation between the parallel side walls of the housing. In this case, the contact pressure gaps to which the saturated vapor is supplied, serves also to heat the housing. It is a further advantage of the present invention that the housing and plates may be easily manufactured to relatively exacting tolerances. Without the features of the present invention, any play between the overlying plates and the housing would have to be avoided, since such play would lead to leakage, and would also adversely effect the heat transfer between the plates and the housing. The present invention provides that the heat is transferred first by metallic contact between the overlying plates and the housing, and in addition, in areas in which no metallic contact occurs, by the condensation of the saturated vapor on the wall of the outer plates and the surface of the side walls of the housing. Thus it is insured that all components of the heating chamber are heated to substantially the same temperature, without requiring any special temperature regulating devices. The resulting improvements in stability establishes the theory that any local formation of a condensate, for example in the form of droplets, becomes noticeable during the heating and operation of the heating chamber by considerable temperature changes. In contrast thereto undue heating leads to the fact that the saturated vapor is heated, at a predetermined pressure, above the boiling temperature of the water.

Within the scope of the present invention, it is desirable that the contact pressure gaps between the side walls of the housing and the outer plates and to which the hot pressurized vapor is delivered, may be at least as large as the area of the contacting surfaces between which the yarn passages are formed. As a result, the compressive forces which are exerted on the plates are balanced, so that the plates float between the side walls of the housing. However, it is preferred that the area of the contact pressure gaps be larger than the opposing contact surfaces which form the yarn passages, so that the contacting surfaces need not be pressed against each other by any additional biasing means.

In a preferred embodiment, the boundaries of the contact pressure gaps are defined by sealing strips, which are mounted in grooves, and which bridge the separation between the opposing surfaces of the outer plates and the side walls of the housing. These sealing strips preferably are substantially the same length as the heating chamber. The contact pressure gaps also have a larger surface area than the contacting surface area formed between the central plate and outer plates. In one embodiment, the contacting surfaces between the central plate and the outer plates are less than the area of the contact pressure gaps, and as a result, a very high surface pressure is formed between the contacting surfaces, which effectively avoids any cracks between the contacting surfaces into which the yarn may move and become pinched.

Preferably, the sealing strips which define the contact pressure gaps are mounted in grooves of trapezoidal outline, and such that the width of the gap in the area of their opening is smaller than the sealing strips, and such that the sealing strips are retained in the grooves.

It is also advantageous for the heat conduction in the heating chamber of the present invention that the vapor is supplied through ducts in the housing, and which lead to the respective contact pressure gaps between the outer plates and the side walls of the housing, and with the outer plates having a tap line which leads from the contact pressure gap to the associated yarn groove.

Some of the objects and advantages of the present invention having been stated, others will appear as the description proceeds when taken in conjunction with the accompanying drawings, in which ——

Referring more particularly to the drawings, a yarn heating chamber embodying the features of the present invention is indicated generally at 10, and which comprises an elongate rigid housing having a U-shaped outline in cross section, to define a back wall 12 and two parallel, transversely spaced apart side walls 13, 14. Each of the side walls 13, 14 includes an inwardly facing flat side wall surface 15 and 16 respectively.

Figure 1:
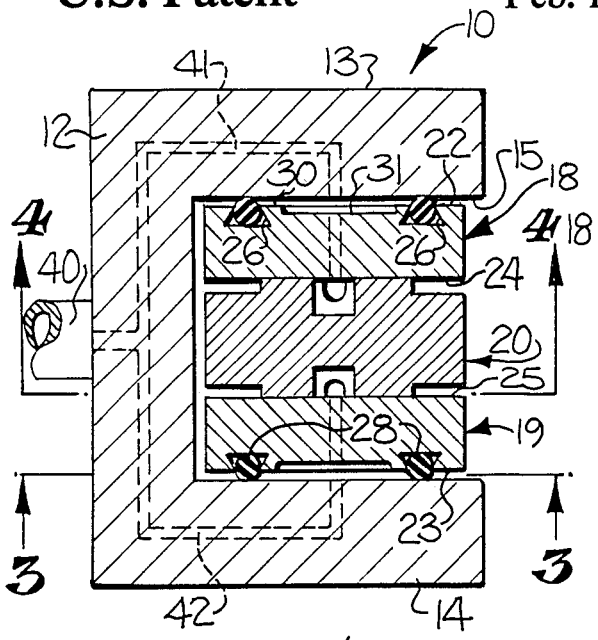
FIG. 1 is a sectional end elevation view of a heating chamber which embodies the features of the present invention, with the chamber shown in its operating position.
Figure 2:
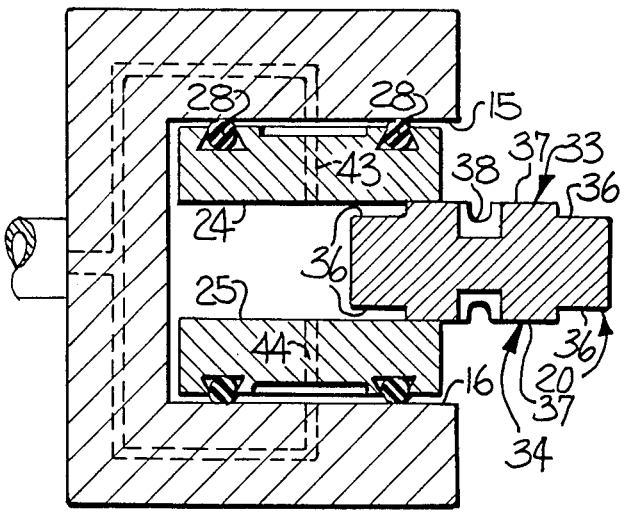
FIG. 2 is a view similar to FIG. 1 but showing the chamber in its threading position.
Figure 3:
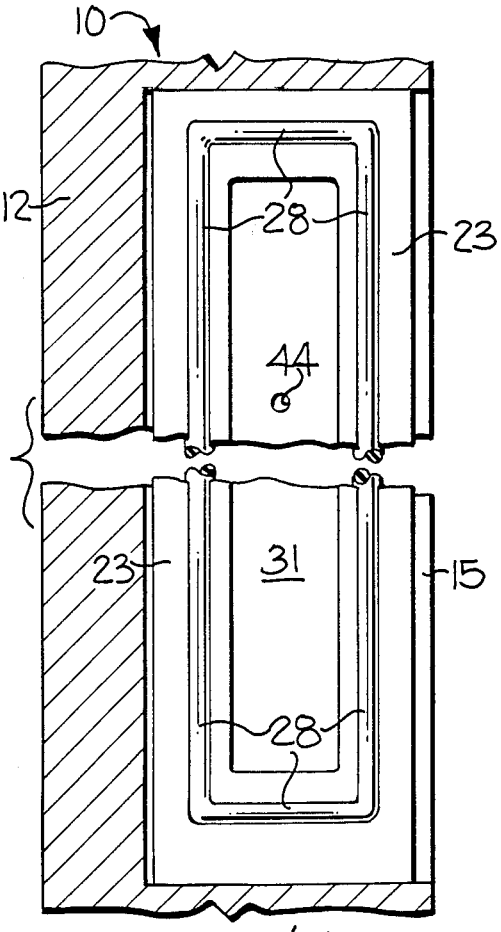
FIG. 3 is a sectional side elevation view of the heating chamber taken substantially along the line 3—3 of FIG. 1.
Figure 4:
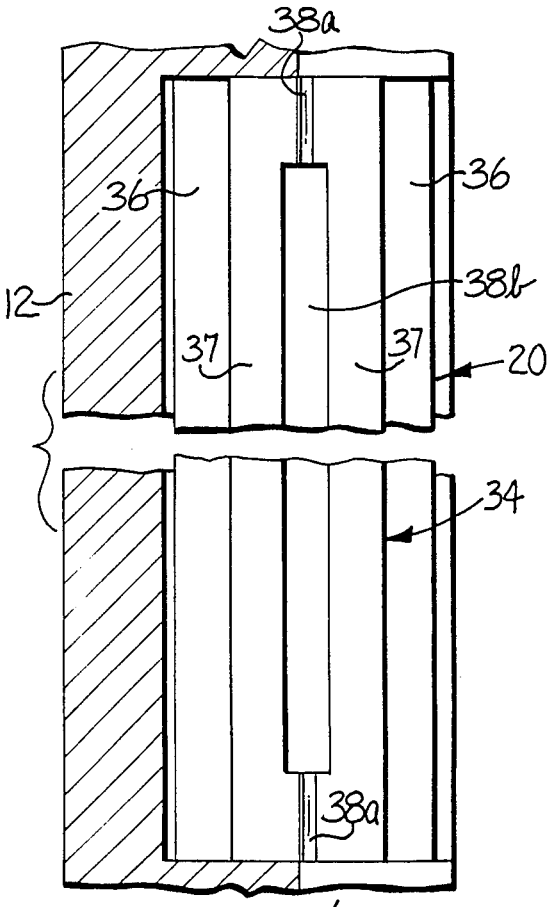
FIG. 4 is a sectional side elevation view taken substantially along the line 4—4 of FIG. 1.

Three plates 18, 19, and 20 extend along the longitudinal length of the housing and are disposed between the side walls 13, 14. More particularly, the two outer plates 18, 19 each have a flat outer surface 22, 23, respectively, opposing the inwardly facing side wall surface of the adjacent side wall, and an opposite flat inner surface 24, 25, respectively. The outer surfaces 22, 23 of the outer plates each include a pair of laterally spaced apart grooves 26 which extend along substantially the entire longitudinal length of the plates, and a transverse groove (note FIG. 3) extending between the longitudinal grooves adjacent each of the ends of the surfaces. These grooves mount sealing strips 28 so that the sealing strips form a continuous closed rectangle as seen in FIG. 2. The grooves 26 are of trapezoidal outline, so that the outer portions of the grooves are more narrow than the sealing strips 28, and so that the sealing strips are held in the grooves.

Each inwardly facing side wall surface 15, 16 and the opposing outer surface 22, 23 of the adjacent outer plate define a contact pressure gap 30 therebetween, and the sealing strips 28 bridge this gap and define the lateral and end boundaries thereof. A recess 31 is also formed on each of the surfaces 22, 23 within the boundary of the contact pressure gap 30, to permit the hot pressurized vapor to enter the gap as further described below, with undue throttling.

The central plate 20 has opposite outer surfaces 33, 34 opposing respective ones of the inner surfaces 24, 25 of the two outer plates. These opposite outer surfaces 33, 34 of the central plate are each cut away by recesses 36 which extend along the longitudinal edges, and which define a central raised flat surface portion 37. Each of these raised surface portions includes a groove 38 extending along the entire longitudinal length thereof and which is adapted to receive a running yarn. This groove comprises relatively narrow end portions **38*a* and a widened central portion 38*b***, with the widened portion being for the purpose of permitting ballooning of the yarn, and reducing friction between the running yarn and groove walls.

The central plate 20 is movably mounted with respect to the two outer plates 18, 19 for lateral movement between an operative position wherein the opposing surfaces of the plates overlie each other and the grooves 38 define a relatively narrow yarn passage. Upon the central plate being moved laterally to the position shown in FIG. 2, the grooves are separated from the opposing inner surfaces 24, 25 of the two outer plates to define a threading position wherein a yarn may be threaded laterally into each of the grooves.

The heating chamber of the present invention further includes heating duct means for introducing a hot pressurized vapor, such as saturated steam, into each of the yarn passages when the plates are in the operative position. This heating duct means includes a vapor supply line 40 which leads to the yarn passages. In particular, the line includes two branches 41, 42 in the housing, with each branch leading to one of the contact pressure gaps 30. Each branch also includes a tap line 43, 44 through the adjacent outer plate, and which connects the contact pressure gap with the yarn groove 38.

As will be apparent, the illustrated arrangement of the heating duct means provides for the biasing of the two outer plates 18, 19 toward each other so as to resiliently engage the central plate 20 therebetween when in its operative position. The means for providing this biasing force includes that portion of the heating duct means which communicates with each of the contact pressure gaps 30 and which serves to conduct a portion of the hot pressurized vapor thereto.

As noted above, the lateral width of the raised flat surface portions 37 on the opposite outer surfaces 33, 34 of the central plate, and which are in direct contact with the inner surfaces 24, 25 of the outer plates, is reduced by reason of the recesses 36 along the longitudinal edges of the central plate. Also, the portions of these surfaces which are in direct contact with each other have a lateral dimension which is less than the lateral dimension of the contact pressure gaps. The recesses 36 are sized so that the contact pressure between the inner surfaces 24, 25 and the raised surface portions 37 are sufficient to seal each of the yarn grooves 38, while maintaining a sufficient contact width to receive the compressive forces. To facilitate sliding movement of the central plate, it may be desirable to include cross bars (not shown) extending across the recesses 36, with the cross bars extending to the level of the raised surface portion 37.

In the drawings and specification, there has been set forth a preferred embodiment of the invention, and although specific terms are employed, they are used in a generic and descriptive sense only and not for purposes of limitation.

That which is claimed is:

1. A heating chamber for thermally processing an advancing yarn, and comprising a housing having a pair of transversely spaced apart and parallel side walls which extend in the longitudinal direction, with each of the side walls including generally parallel, inwardly facing side wall surfaces, a pair of longitudinally extending outer plates disposed between said side walls, with each of said outer plates having an outer surface opposing the inwardly facing side wall surface of the adjacent side wall, and an opposite, inner surface, a longitudinally extending central plate disposed between said outer plates and having opposite outer surfaces opposing respective ones of the inner surfaces of the two outer plates, with each of the opposite outer surfaces of the central plate including a discontinuity extending along the longitudinal length thereof, and with said central plate being laterally movable with respect to said two outer plates for movement between an operative position wherein the opposing surfaces of said plates overlie each other and said discontinuities define a relatively narrow yarn passage on each side of said central plate, and a threading position wherein said discontinuities are separated from the inner surfaces of said two outer plates to facilitate threading of yarns into the discontinuities, heating duct means for introducing a hot pressurized vapor into said yarn passage when said plates are in the operative position, and means for biasing said two outer plates inwardly toward each other so as to resiliently engage said central plate therebetween when in said operative position wherein each of said inwardly facing side wall surfaces and the opposing outer surface of the adjacent outer plate define a contact pressure gap therebetween, and said biasing means comprises a portion of said heating duct means which communicates with each of said gaps for conducting a portion of said hot pressurized vapor thereto.

2. The yarn heating chamber as defined in claim 1 wherein a pair of laterally spaced apart sealing strips are mounted between each of said inwardly facing side wall surfaces and the opposing outer surface of the adjacent outer plate, with said sealing strips of each pair extending along substantially the entire longitudinal length of said plates, and with said sealing strips of each pair defining the lateral boundary of the associated contact pressure gap.

3. The yarn heating chamber as defined in claim 2 wherein each of the opposite outer surfaces of said central plate and the adjacent opposing inner surface of the adjacent outer plate have portions which are in direct contact with each other in said operative position, and wherein said portions in direct contact have a lateral width less than the lateral width of the associated contact pressure gap.

4. The yarn heating chamber as defined in claim 3 wherein said surface portions in direct contact are substantially flat, and each of said discontinuities is in the form of a groove in the associated outer surface of said central plate.

5. The yarn heating chamber as defined in claim 4 wherein each of said sealing strips is mounted in a groove having a trapezoidal cross section so as to retain the sealing strips therein.

6. The yarn heating chamber as defined in claim 4 wherein said heating duct means extends through said side walls of said housing so as to transversely communicate with each of said contact pressure gaps, and then extends transversely from each of said gaps through the associated outer plate to a position opposite the associated groove when said central plate is in said operative position.

7. A heating chamber for thermally processing an advancing yarn, and comprising a longitudinally extending housing of U-shaped cross section and having a pair of transversely spaced apart and parallel side walls and a back wall extending between said side walls, with each of the side walls including generally parallel, inwardly facing flat side wall surfaces, a pair of longitudinally extending outer plates disposed between said side walls, with each of said outer plates having a flat outer surface opposing the inwardly facing side wall surface of the adjacent side wall, and an opposite, generally flat inner surface, and with each of said inwardly facing side wall surfaces and the opposing outer surface of the adjacent outer plate defining a contact pressure gap therebetween, a longitudinally extending central plate disposed between said outer plates and having opposite outer surfaces opposing respective ones of the inner surfaces of the two outer plates, with each of the opposite outer surfaces of the central plate including a generally flat central portion having a groove extending along the longitudinal length thereof, and with said central plate being laterally movable with respect to said two outer plates for movement between an operative position wherein the opposing surfaces of said plates overlie each other and said grooves define a relatively narrow yarn passage on each side of said central plate, and a threading position wherein said grooves are separated from the inner surfaces of said two outer plates to facilitate threading of yarns into the grooves, heating duct means for introducing a hot pressurized vapor into each of said contact pressure gaps and into said yarn passages when said plates are in the operative position, and such that the pressurized vapor in said gaps acts to bias said two outer plates inwardly toward each other so as to resiliently engage said central plate therebetween when in said operative position.

8. The yarn heating chamber as defined in claim 7 wherein said heating duct means includes one branch extending transversely from the interior of one of said side walls through the associated contact pressure gap and outer plate to one of said yarn passages, and a second branch extending transversely from the interior of the other of said side walls through the associated contact pressure gap and outer plate to the other of said yarn passages.

9. The yarn heating chamber as defined in claim 8 wherein each of the longitudinal side edges of each of said outer surfaces of said central plate includes a recess, and such that said flat central portion of each of said outer surfaces is defined between a pair of said recesses.

10. The yarn heating chamber as defined in claim 9 wherein the lateral width of each of said flat central portions of said central plate is less than the lateral width of said contact pressure gaps.

11. The yarn heating chamber as defined in claim 10 wherein each of said outer surfaces of said outer plates mounts a pair of laterally spaced apart sealing strips, with said sealing strips defining the lateral boundary of the associated contact pressure gap.

12. The yarn heating chamber as defined in claim 11 wherein each of said outer surfaces of said outer plates mounts a laterally extending sealing strip adjacent each end of said plate and so that the sealing strips have a closed rectangular outline.

13. The yarn heating chamber as defined in claim 11 wherein each of said grooves comprises relatively narrow end portions and a widened central portion, and such that the widened central portion permits ballooning of the yarn and reduces friction between the yarn and groove walls.

* * * * *